US009051694B2

(12) United States Patent
Bosterling et al.

(10) Patent No.: US 9,051,694 B2
(45) **Date of Patent: *Jun. 9, 2015**

(54) SYSTEM FOR FIXING A RAIL AND GUIDE PLATE FOR SUCH A SYSTEM

(75) Inventors: Winfried Bosterling, Neuenrade (DE); Adrian Bednarczyk, Lüdenscheid (DE); André Hunold, Iserlohn (DE); Nicole Wiethoff, Balve (DE)

(73) Assignee: Vossloh-Werke GmbH, Wersohl (DE)

( * ) Notice: Subject to any disclaimer, the term of this patent is extended or adjusted under 35 U.S.C. 154(b) by 17 days.

This patent is subject to a terminal disclaimer.

(21) Appl. No.: 13/581,880

(22) PCT Filed: Mar. 2, 2011

(86) PCT No.: PCT/EP2011/053075

§ 371 (c)(1),
(2), (4) Date: Nov. 2, 2012

(87) PCT Pub. No.: WO2011/110454

PCT Pub. Date: Sep. 15, 2011

(65) Prior Publication Data

US 2013/0153671 A1 Jun. 20, 2013

(30) Foreign Application Priority Data

Mar. 12, 2010 (EP) ..... 10156434

(51) Int. Cl.
*E01B 9/30* (2006.01)
*E01B 9/48* (2006.01)

(52) U.S. Cl.
CPC . *E01B 9/30* (2013.01); *E01B 9/483* (2013.01); *E01B 9/303* (2013.01)

(58) Field of Classification Search
CPC ..... E01B 9/303; E01B 9/483; E01B 9/306; E01B 9/30; E01B 9/34
USPC ..... 238/349, 351
See application file for complete search history.

(56) References Cited

U.S. PATENT DOCUMENTS 5,678,762 A * 10/1997 Wood et al. ..... 238/351
2010/0308123 A1 12/2010 Bosterling

FOREIGN PATENT DOCUMENTS

DE 202007018500 U1 9/2008
WO WO2008/145240 * 12/2008
WO 2009043822 A1 4/2009

* cited by examiner

*Primary Examiner* — Mark Le
(74) *Attorney, Agent, or Firm* — The Webb Law Firm

(57) ABSTRACT

A system for fixing a rail onto a foundation and to a guide plate. The system comprises a spring element, with at least one spring arm, which can be clamped against the foundation by means of a clamping element, an adapter piece, with a contact surface section, which sits on an end section of the spring arm, and a guide plate. The guide plate has a contact surface for the rail foot and a sliding surface which adjoins the contact surface via which the adapter piece can be moved from a pre-assembly position in which it sits on the guide plate with its contact surface section to an assembly position in which it is seated, with its contact surface section, on the rail foot of the rail to be fixed. A stop is provided on the sliding surface against which the adapter piece rests in the pre-assembly position.

13 Claims, 5 Drawing Sheets

SYSTEM FOR FIXING A RAIL AND GUIDE PLATE FOR SUCH A SYSTEM

FIELD OF THE INVENTION

The invention relates to a system for fixing a rail, this system comprising a spring element, having at least one spring arm, which can be clamped against a foundation by means of a clamping element, an adapter piece which sits on an end section of the spring arm of the spring element, the adapter piece having a contact surface section formed at its periphery, and a guide plate which has, on its face allocated to the rail foot, a contact surface and, on its free top face, a sliding surface, adjoining the contact surface, via which the adapter piece can be moved from a pre-assembly position in which it sits on the guide plate with its contact surface section, into an assembly position in which it sits with its contact surface section on the rail foot of the rail to be fixed, in order to transfer the elastic retaining force exerted by the spring element onto the rail foot.

The invention also relates to a guide plate intended for such a system.

BACKGROUND OF THE INVENTION

A system of the type mentioned at the beginning is known, for example, from DE 20 2007 018 500 U1. In the known system, the adapter piece isolates the clamp, used there as a spring element, from the rail. For this purpose, the adapter piece is manufactured from an electrically non-conductive material. In order to allow a particularly simple assembly at the same time, the adapter piece in the known system has a holder, which is adapted to the shape of the end section allocated to the isolating clip such that the spring section can be inserted into it in form fit. The end section of the spring element concerned can therefore be inserted into the holder such that at least one segment of its periphery is surrounded by material of the adapter piece. In addition, the known adapter piece has a contact surface extending under the holder. This contact surface guarantees that the adapter piece is always guided such that the end section of the spring element engaging in its respective holder constantly remains in the holder concerned. In this way, the adapter piece can easily be moved from a pre-assembled position on the guide plate of the known system onto the rail foot, without manual intervention of a fitter or particular measures by an assembly machine being required in addition.

However, under the rough conditions which exist in practice, unintended changes in the positions of the spring element and the adapter repeatedly occur. These may be large enough to hamper the full assembly of the system from the pre-assembly state.

SUMMARY OF THE INVENTION

Against this background, it was the object of the invention to provide a system of the type described in the opening paragraph in which it is ensured, by simple means, that the adapter piece, and with it the spring element coupled to it, remains securely in the particular pre-assembly position until the final assembly takes place, even under the loads which occur in practice.

It was also the intention to specify a guide plate which, when used in a system of the type specified in the opening paragraph ensures, by simple means, that the adapter is secured in position in the way required.

In relation to the system for fixing a rail, this object was achieved by the invention in that such a system is formed in the manner given in claim 1.

In relation to the guide plate, the way in which the above-mentioned object is achieved in accordance with the invention is that the guide plate is designed in the way specified in claim 6.

DESCRIPTION OF THE PREFERRED EMBODIMENTS

Advantageous embodiments of the invention are given in the dependent claims and are explained below individually.

In a guide plate according to the invention, the sliding surface provided for the adapter piece rises in the direction of the contact surface of the guide plate. At the same time, a stop is provided on the sliding surface. In the pre-assembly position, the adapter piece is pressed against this stop as a result of the retaining force applied to it which is exerted by the spring element, which later is likewise arranged on the guide plate and is coupled to the adapter piece by a respective one of its spring arms. In order to be moved into the final assembly position, the adapter piece must therefore be pushed, starting from the stop, obliquely upwards on the slide surface with the consequence that the spring forces exerted by the spring element increase and an additional force load must be overcome. As this cannot be achieved without targeted force applied externally, the adapter piece and with it the spring element are automatically held in the pre-assembly position until the final assembly process begins.

The invention has thus been successful, in a particularly simple way, in securing the adapter piece and the spring element in their pre-assembly position without any additional components being required for this purpose or without the procedure for the final assembly which has proved successful in practice having to be altered.

Basically, the invention is suitable for any type of rail fastener, regardless of whether a spring element having one or two spring arms is used to generate the retaining force. However, it has proved to be particularly well adapted to practical considerations for the spring element to be a ω-shaped clamp having two spring arms and for each of the spring arms to have an adapter piece allocated to it and for a sliding surface which rises in the direction of the contact surface to be provided on the guide plate.

The latter provision makes particularly good sense when the adapter piece is mounted on the end section of the spring arm to be rotatable on a rotary axis, if at the same time the adapter piece has on its periphery at least two contact surface sections of which, depending on the rotary position of the adapter piece at the time, a particular one rests against the rail foot, and if in addition one contact surface section on the adapter piece has a greater distance from the rotary axis of the adapter piece than the other contact surface section. In this embodiment of the invention, the adapter piece, which is used as an isolator in the prior art, takes on the function of a compensating element which can be used to adjust the forces which are applied by the respective spring element to the rail foot to be fixed. In accordance with the invention, the adapter piece may be so designed for this purpose, and may be so arranged on the spring arm of the spring element of a system according to the invention, that it can be adjusted after the fashion of an eccentric to allow the distance between the free end of the spring element and the surface of the rail foot to be set, which distance is significant with regard to the tensioning of the spring element and with regard to the force applied by the spring element. In this way, the distance between the free end of the spring element and the rail foot and, hand in hand with it, the retaining force exerted by the spring element on the rail can be increased by having the adapter piece supported on the rail foot by the contact surface section which has a great distance from the respective free end of the spring arm of the spring element. Similarly, the effective retaining force can be reduced by rotating the adapter piece in such a way that it is supported on the rail foot by a contact surface section which is arranged at a shorter distance from the free end of the allocated spring arm. In this way it is thus possible for example, with equally few problems, to execute a height compensation between two adjacent fixing points for example by varying the height of the rail foot above the foundation or one of the other components of the respective support plate carrying the rail fixing system by means of one or more intermediate layers, wherein in this situation the guide plate supporting the respective spring element remains directly on the support plate or the foundation. The change, accompanying the height variation of the support of the rail foot, in the retaining force applied by the spring element in the finally assembled state onto the rail foot can likewise be compensated by a corresponding adjustment of the adapter piece.

For the spring element to be electrically isolated from the rail foot in the system according to the invention too, the adapter piece is preferably manufactured from an electrically non-conductive material, in particular from a plastics material.

To make it possible for the adapter piece to slide as easily as possible on the sliding surface allocated to it on the guide plate, the sliding surface may be even and of a uniform inclination.

An embodiment of a guide plate according to the invention which is particularly easy to manufacture is obtained when the stop for the adapter piece which is present in accordance with the invention on the guide plate is in the form of a step integrally formed on the guide plate. This proves to be particularly advantageous when the guide plate is produced in one piece from for example a mouldable or press-formable material.

If the guide plate according to the invention is used in a system for fixing a rail in which an elastic intermediate layer is arranged between the rail foot and the respective foundation to ensure that the support for the rail has a defined flexibility, then excessive compression of the elastic intermediate layer can easily be avoided by forming on the contact surface of the guide plate a protrusion which protrudes towards the rail and which is so arranged that it engages below the rail foot in the assembly position. The height of the protrusion will preferably be sized in this case in such a way that the rail foot sits down on it after the elastic layer has been depressed by a certain amount, and the elastic layer is thus reliably protected against any deformation exceeding its elasticity.

The amount of material needed for the manufacture of the guide plate, and hence the weight of a guide plate according to the invention, can be minimised by forming a recess in its underside. This recess may continue to the contact surface of the guide plate. To stiffen the guide plate when this is the case, reinforcing ribs may be formed in the region of the recess if required.

On its side facing away from the contact surface, the guide plate may have a support section which has on its top face a contact surface to support a transition section of a spring element in a pre-assembly position, and which at the same time limits a channel formed in the guide plate in which the transition section of the spring element sits in the fully assembled position. In order to have as small a volume of material as possible in the region of the support section too, at least one recess may be formed in the support section from the side facing away from the contact surface. In this case too a plurality of recesses may be so formed such that there are ribs between them which ensure that the support section has the requisite load-bearing capacity.

If, in a system according to the invention, it is to be possible to subsequently assemble or exchange a support plate for purposes of height regulation or improvement of the uniformity with which the loads taken up by the components of the system are distributed, this can be executed in a simple manner in that a support plate is provided, which extends transverse to the rail to be fastened over the width of the guide plate, and is arranged for adjustment of height differences between the foundation and the guide plate, wherein the support plate has a rectangular basic shape and features a passage opening for the clamping element for clamping the spring element, and wherein the support plate is divided into two parts along a joint line which is guided from the one long side of the support plate aligned transverse to the rail to be fixed, at a distance from the one short side to the passage opening and from there, intersecting the passage opening, is guided in the direction of the short side of the support plate. The support plate provided in this embodiment is thus divided into two parts abutting each other, of which at least one part extends along the short side of the support plate over its entire width and on which a section extending in the longitudinal direction of the support plate is formed, which receives at least partly the passage opening for the clamping element concerned. The other part of the support plate fills the section cut out of the first part, limiting the part of the passage opening of the support plate which is not surrounded by the first part.

A first advantage of the design of a support plate according to the invention is that the two parts of the support plate can easily be mounted subsequently on an existing fixing system, in that viewed in the longitudinal direction of the rail one part is inserted from the one side and the other part from the other side below the other components of the fixing system already mounted. As soon as the two parts of the support plate are fully inserted, they closely surround the clamping element so that despite the division of the support plate, the same continuous support, over a large area, of the components and material layers resting on the support plate is guaranteed as with an undivided support plate.

A further advantage important in practice of the design of a support plate according to the invention is that it is undivided at least in the area of its one short side. In this way it is guaranteed that the components and material layers resting on the support can be securely supported even if very high pressures are exerted on the support plate or if the foundation has a degree of flexibility. The section of the one part of the support plate extending over the short side ensures that the support plate retains its form even under heavy load and its two parts cannot be pushed apart.

Additionally advantageous to the configuration according to the invention of a support plate is that both of its parts can be formed to be identical, whereby a cheap and simple manufacture is possible.

BRIEF DESCRIPTION OF THE DRAWINGS

The invention is now explained below with reference to a drawing showing an exemplary embodiment in more detail. The drawings show schematically.

DETAILED DESCRIPTION

Figure 1:
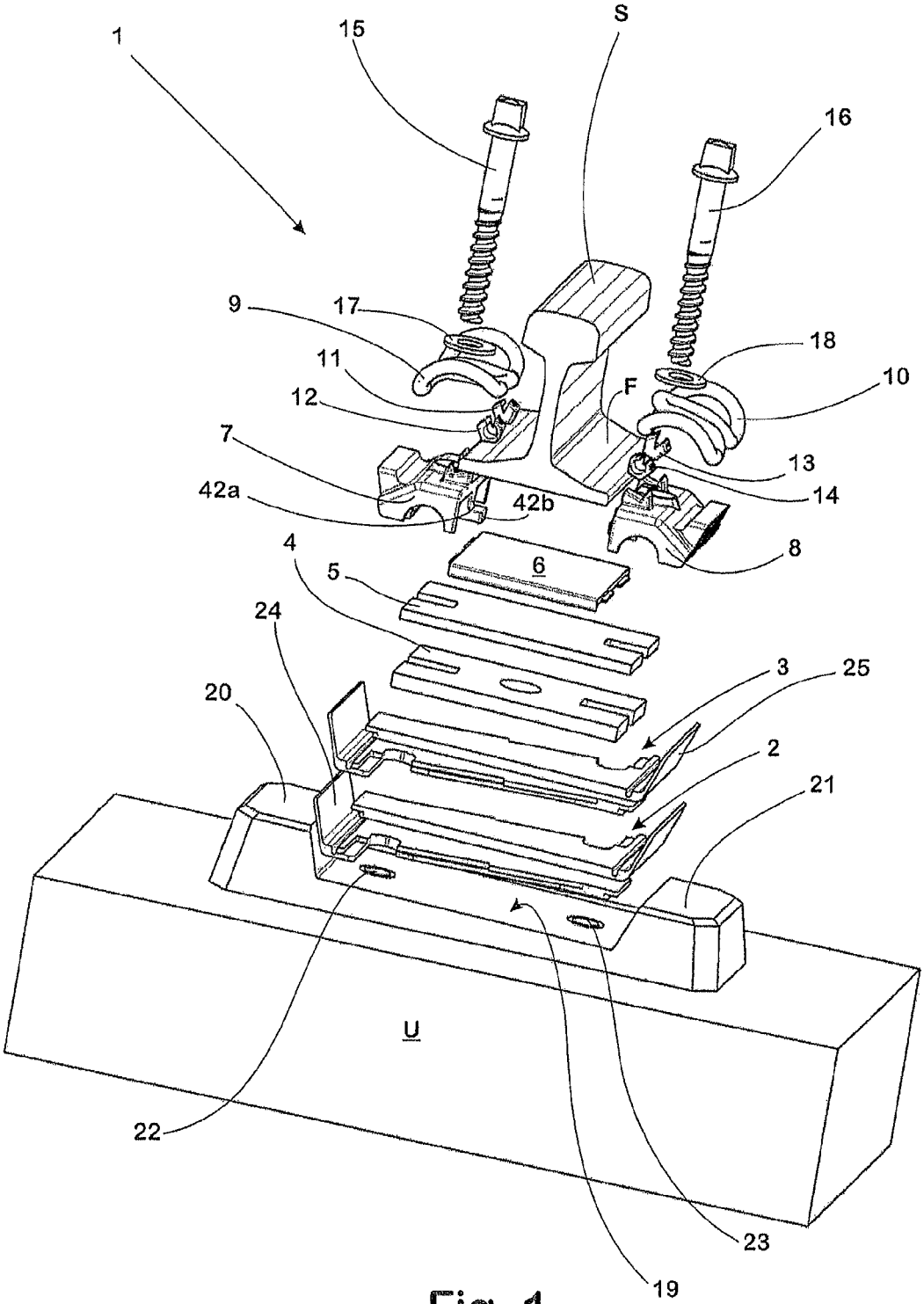
FIG. 1 a system for fixing a rail in an exploded view.
Figure 2:
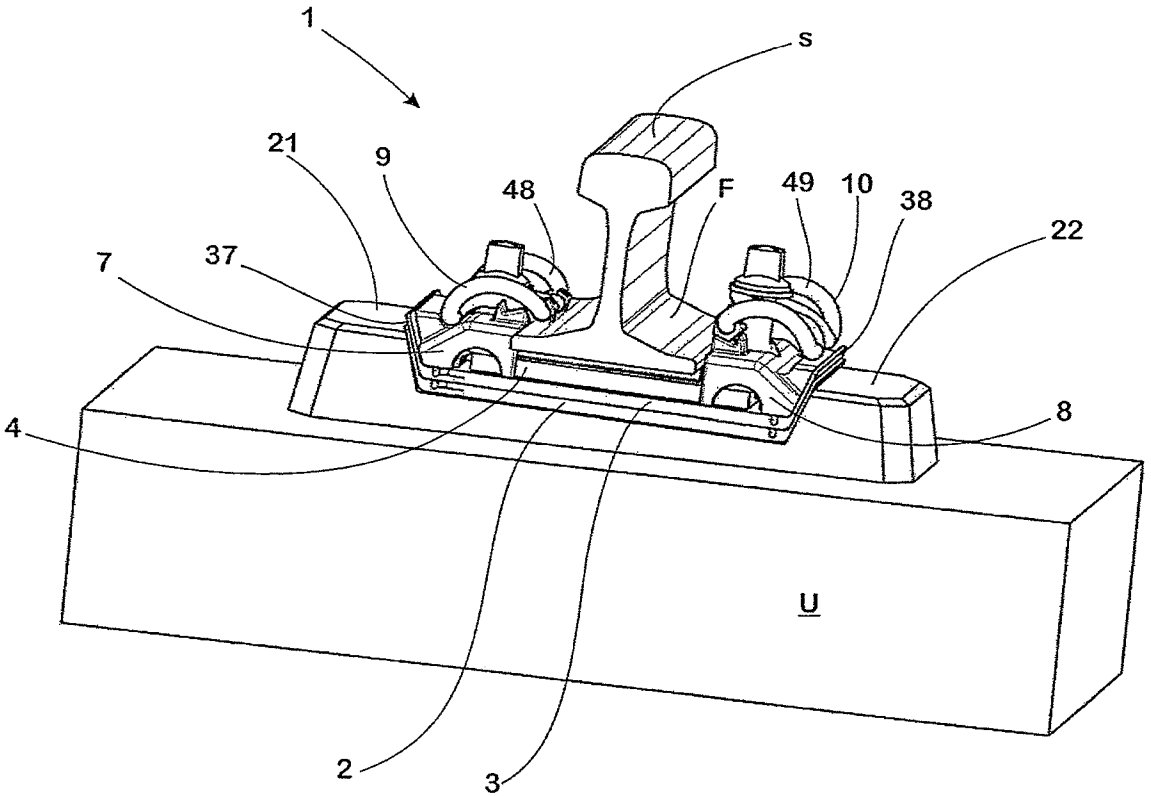
FIG. 2 the system in final assembled state in a perspective view.
Figure 3:
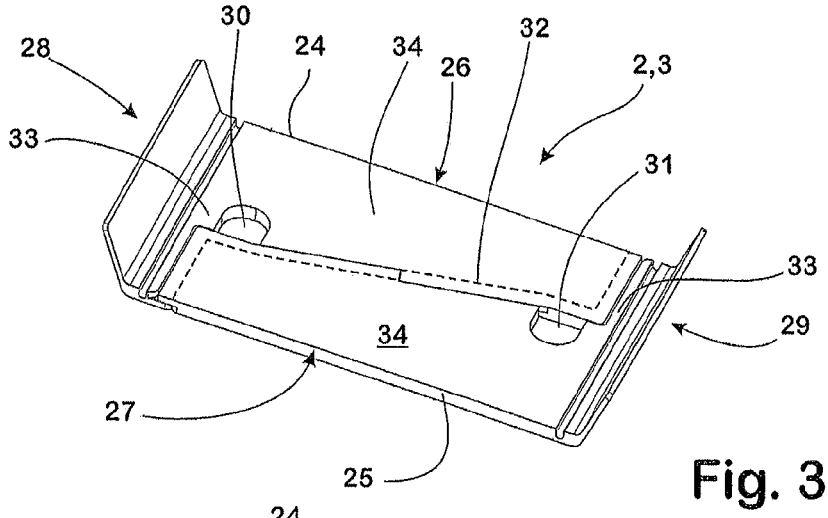
FIG. 3 a support plate in a perspective view from above.
Figure 4:
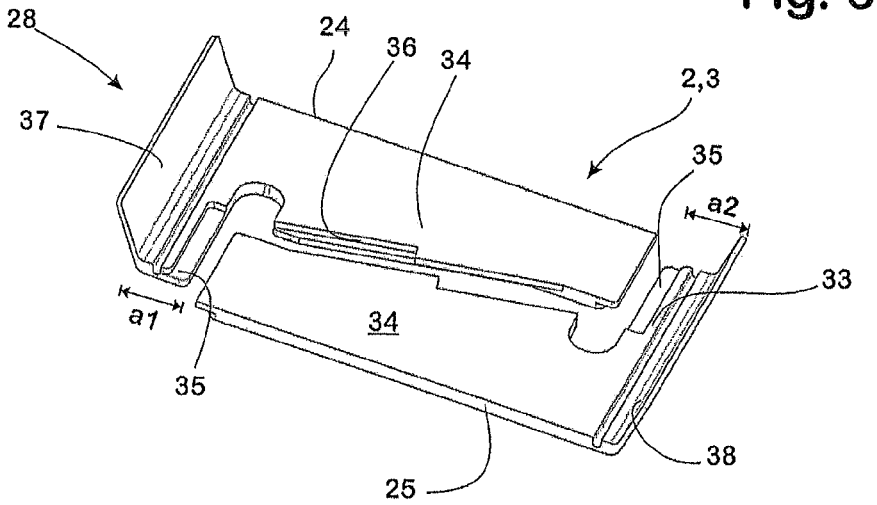
FIG. 4 the parts of the support plate in a perspective view from above.
Figure 5:
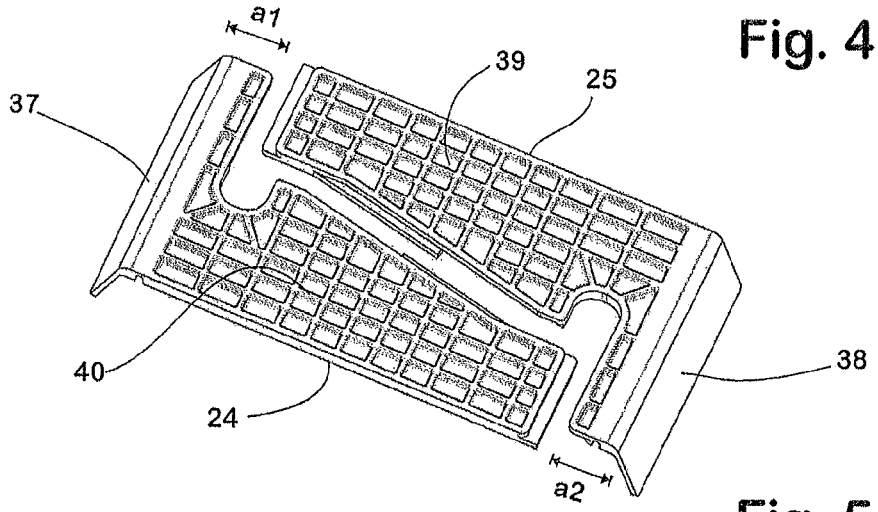
FIG. 5 the parts of the support plate in a perspective view from below.
Figure 6:
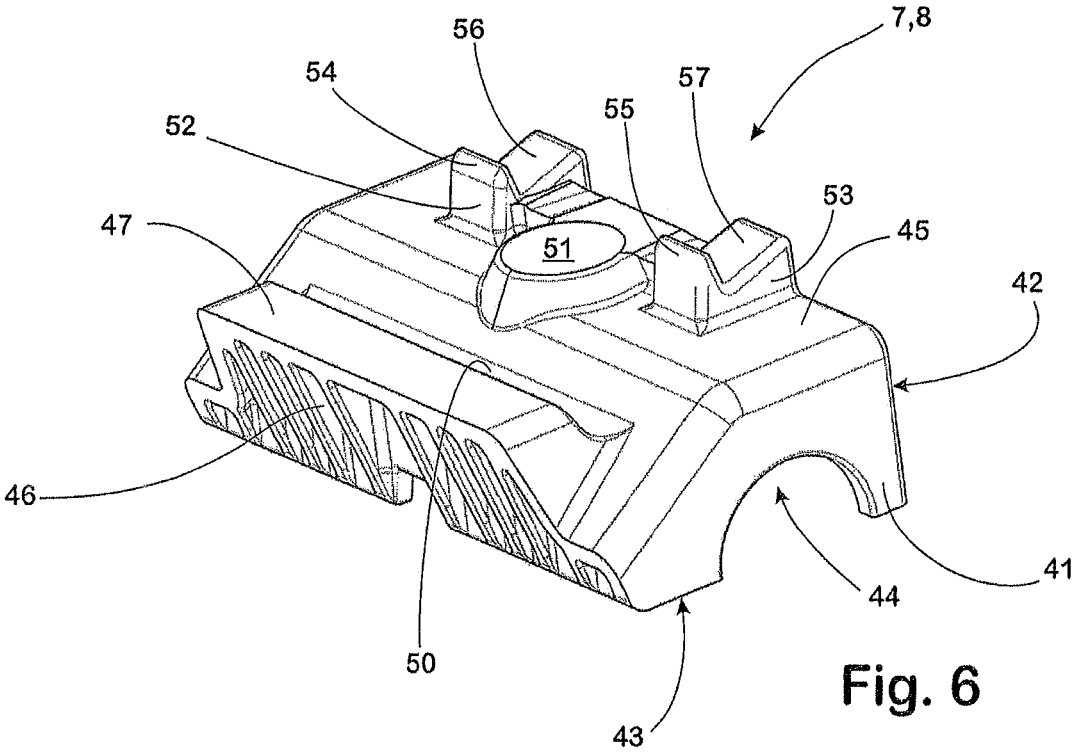
FIG. 6 a guide plate in a perspective view.
Figure 7:
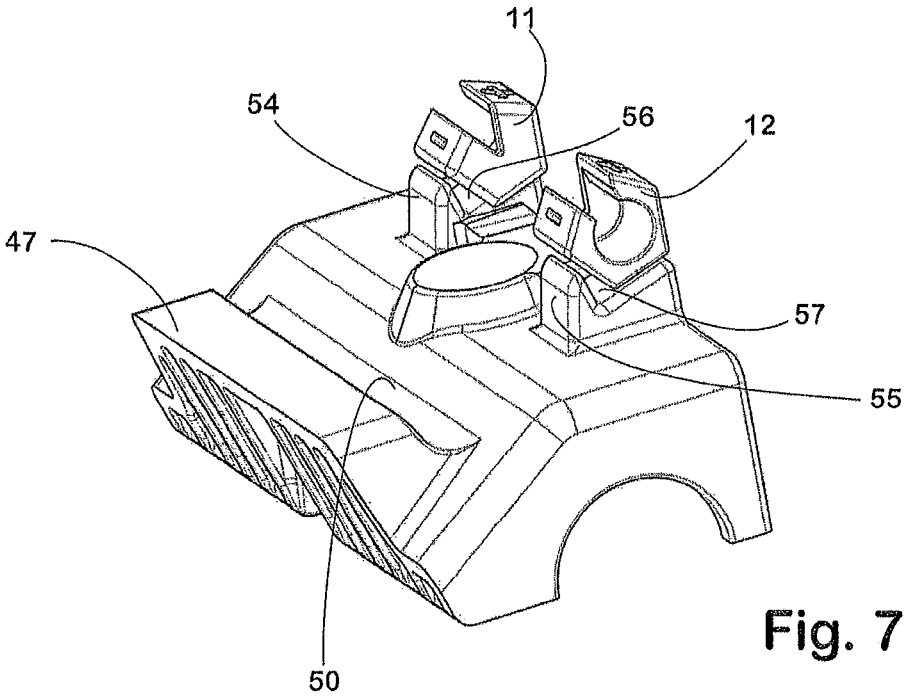
FIG. 7 the guide plate with adapter pieces thereon.
Figure 8:
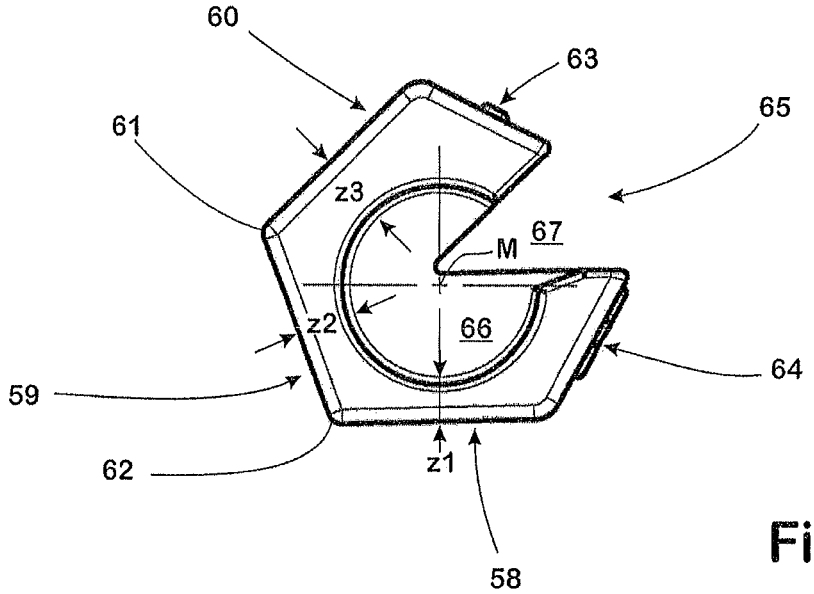
FIG. 8 an adapter piece in a front view.
Figure 9:
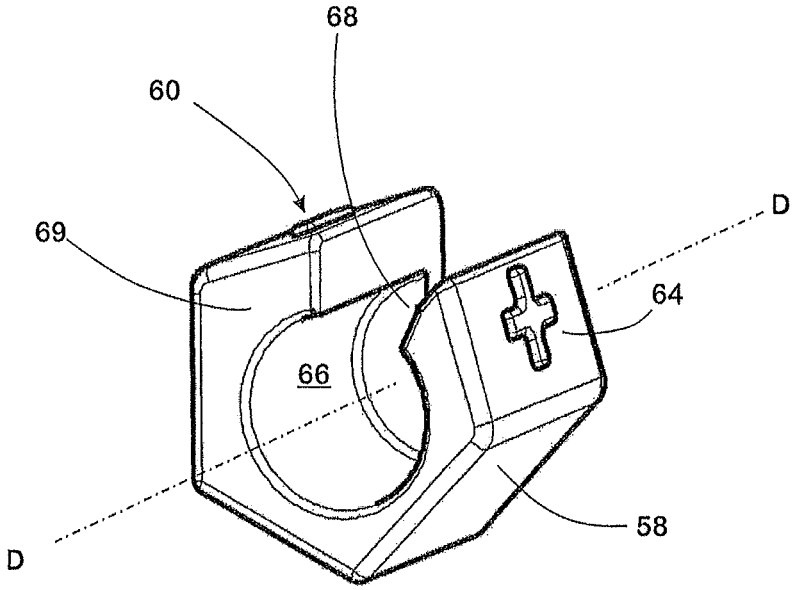
FIG. 9 the adapter piece in a perspective view.

The system 1 for fixing a rail S on a solid foundation U formed for example by a concrete sleeper or concrete plate comprises a first support plate 2, a second support plate 3, an elastic intermediate layer 4, a pressure distribution plate 5, a height adjustment plate 6, a first guide plate 7, a second guide plate 8, two spring elements 9, 10 formed as ω-shaped clamps, two pairs of adapter pieces 11-14 and two clamping elements 15, 16 formed as clamping screws which act each via a washer 17, 18 on the centre loop of the spring elements 9, 10.

The fixing system 1 sits in a holder 19 moulded as one piece on the solid foundation and limited on each of its short sides running parallel to rail S by a support shoulder 20, 21. In each contact surface of the holder 19 present between the support shoulders 20, 21 and adjacent to the support shoulders 20, 21, a plastic peg 22, 23 is inserted in the foundation U. Screwed into each plastic peg 22, 23 on assembly of the system 1 is one of the clamping elements 15, 16 to clamp the spring elements 9, 10.

The support plates 2, 3 each composed of two point-symmetrically shaped parts 24, 25 have a rectangular form with two parallel long sides 26, 27 and two likewise parallel short sides 28, 29, and extend over the entire width of the holder 19. In the support plates 2, 3 two passage openings 30, 31 are formed, each of which is positioned adjacent to one of the short sides 28, 29 and centrally between the long sides 26, 27 such that when the support plate 2, 3 is inserted in the holder 19, they align with the opening of the plastic peg 22, 23 inserted in the foundation U.

The joint line 32 at which the two parts 24, 25 of the support plates 2, 3 meet runs, starting from the edge of the one long side 26, first parallel to the edge of the short side 28 allocated to the first passage opening 30, wherein the distance a1 from the edge concerned corresponds to the shortest distance between the edge of the passage opening 30 and the edge of the short side 28. This section 28 of the joint line is guided up to the passage opening 30 in order there to bend substantially at right angles to the edge of the short side 28 and to be guided, intersecting the passage opening 30 at its edge allocated to the long side 26, in the direction of the other passage opening 31. As soon as it has passed the passage opening 30, the joint line 32 bends in the direction of the other long side 27 so that it meets the passage opening 31 on its side allocated to the long side 27. There the joint line 32 again bends so that it runs substantially at right angles, intersecting the passage opening 31 at its edge allocated to the long side 27, to the edge of the other short side 29 until it has passed the passage opening 31. At this point the joint line 32 assumes a course aligned parallel to the edge of the short side 29 until it reaches the edge of the long side 27. The distance a2 of the section of the joint line 32 running parallel to the edge of the short side 29 corresponds to the smallest distance between the edge of the passage opening 31 and the edge of the short side 29.

With this course of joint line 32, the two parts 24, 25 of the support plate 2, 3 each have a section 33 extending over the entire width B of their short sides 28, 29. From this section 33 projects a further section 34 which in each case borders one of the long sides 26, 27 of the support plate 2, 3 concerned and the width of which in the area adjacent to section 33 corresponds to half the width B of the support plate plus half the diameter of the passage opening 30, 31 formed therein, whereas its width in the area of its free end is equal to half the width B of the respective support plate 2, 3 less half the diameter of the other passage opening 31, 30.

On the allocated ends of the parts 24, 25 of the support plates 2, 3, abutting in the joined state, correspondingly shaped protrusions and recesses 35, 36 are formed, which in the assembled state overlap each other by form fit and thus in the installation state prevent the parts 24, 25 from lifting in a direction perpendicular to the foundation U even under heavy load.

On each of the short sides 28, 29 of the support plates 2, 3 a shoulder 37, 38 is formed, which in the installation position are aligned pointing upwards away from sections 33, 34 and extend over the entire width B of the respective support plate 2, 3. The shoulders 37, 38 are formed and aligned such that they lie flush on the support shoulders 20, 21 in the state inserted in the holder 19.

To minimise their weight and save material, in the area of sections 33, 34 in the underside of parts 24, 25 regularly arranged recesses 39 are formed, between which ribs 40 are arranged, which in the installation state stand on the contact surface of the holder 19.

To achieve the height adjustment necessary in the present exemplary embodiment, the two support plates 2, 3 are arranged stacked on each other in the holder 19.

On any subsequent installation of the support plates 2, their parts 24, 25 are each pushed from one long side of the holder 19 below the other components of the system 1 until they abut each other and their protrusions and rebates 35, 36 engage. In this position the parts with their passage openings 30, 31 surround the screw shafts of the clamping elements 15, 16 with close tolerance so that despite the division of the support plates 2, 3, a maximum support area for the components of system 1 lying above them is guaranteed.

On the top support plate 3 lies the elastic intermediate layer 4 which guarantees the necessary flexibility of the rail fixing formed by the system 1.

The load absorbed by the rail S on passage of a rail vehicle not shown here is distributed over a large area onto the intermediate layer 4 by means of the pressure distribution plate 5 lying on the intermediate layer 4.

The intermediate layer 4 and the pressure distribution plate 5 each have slots on their short sides in which fit the clamping elements 15, 16 in the final assembled state.

The width of the intermediate layer 4 and the pressure distribution plate 5 is in each case less than the width B of the support plates 2, 3 so that along the long sides 26, 27 of the support plates 2, 3 is a short edge strip on which the guide plates 7, 8 stand with their side feet 41, 42 allocated to the rail foot F.

In order to compensate for any further height tolerances, on the pressure distribution plate 5 lies the height adjustment plate 6 on which the rail S stands with its rail foot F.

The guide plates 7, 8 made from a reinforced plastic are identical in structure. Each of them in the known manner is arranged on one of the long sides of the rail S in order to guide the rail S at the side. At the same time the guide plates 7, 8 also in a known manner serve as a bearing for the spring elements 9, 10 seated thereon.

On their face allocated to the rail foot F the guide plates 7, 8 have a contact surface 42 with which in the final mounted state they lie sideways against the rail foot F. The contact surface 42 in interrupted by two openings which lead to a recess 44 formed starting from the underside 43 of the guide plates 7, 8. In the area of the recess 44 reinforcing ribs not visible here are formed, which carry the roof 45 of the guide plates 7, 8 with spring elements 9, 10 clamped thereon.

At the side facing away from the contact surface 42, on these guide plates 7, 8 a support section 46 with recesses and reinforcement ribs is formed, on the free top face of which a flat support surface 47 is formed. On this support surface 47 in the pre-assembly position sit the transition sections of the spring elements 9, 10 which connect the spring arms 48, 49 of the spring elements 9, 10 with their centre loop. At the same time the support section 46 limits a channel 50 formed in the top of the guide plates 7, 8 and extending parallel to the contact surface 42, in which the transition sections of the spring elements 9, 10 sit in the final mounted position.

At a central point a passage opening 51 is formed in the roof 45 of the guide plates 7, 8, through which opening the screw shaft of the clamping element 15, 16 concerned is guided. The passage opening 51 is surrounded by a peripheral collar which firstly prevents the penetration of water into the opening 51 and secondly forms a guide for the central loop of the respective spring element 9, 10.

On both sides of the passage opening 51 and at an even distance from this on the top of the guide plate 7, 8 a step 52, 53 is formed in each case, which reaches to the front contact surface 42. The steps 52, 53 in the final mounted system firstly form a side guide for the centre loop of the respective allocated spring element 9, 10. Secondly a wedge-shaped recess is formed in the steps 52, 53 starting from the top. In this way, at the end of the steps 52, 53 allocated to the support section 46, an upright stop 54, 55 and a flat slide surface 56, 57 are formed. These slide surfaces 56, 57 rise continuously starting from the stop 54, 55 in the direction of the contact surface 42 until they reach the front edge of the respective stop 52, 53 allocated to the contact surface 42.

Between the openings formed in the contact surface 42, a centre post 42*a* is provided in the area of the contact surface 42, on the lower end of which post a protrusion 42*b* is formed, directed away from the respective guide plate 8, 9 at right angles to the contact surface 42. The protrusion 42*b* is positioned such that in the final mounted position it engages below the rail foot F. This safely prevents any lifting of the guide plates 8, 9 under the loads occurring in practice.

The spring elements 9, 10 formed as w-shaped clamps each have on their spring arms 48, 49 a cranked end section which, in the final mounted system 1, is aligned substantially parallel to the rail S. One of the adapter pieces 11-14 is mounted on each end section, pivoting about a rotary axis D coinciding with the long axis of the end section concerned.

Viewed from their front, the adapter pieces 11-14 have a pentagonal form. On the peripheral surface of the adapter pieces 11-14 three equal-sized contact surface sections 58, 59, 60 are formed, directly adjacent to each other and separated in each case by an edge 61, 62. Next to the two outer contact surface sections 58, 60 are two marking sections 63, 64. These marking sections 63, 64 can carry markings which indicate the increase or reduction in spring tension associated with rotation in the direction concerned.

The marker sections 63, 64 are separated by a slot 65 which is formed in the adapter pieces 11-14 from the radial direction and extends to a holder 66 formed in the adapter pieces 11-14 from the one front face. The slot 65 intersects a triangular opening 67 in the base 68 of the holder 66 so that any moisture or vapours collecting in the holder 66 can escape from the holder 66 via the opening 67.

The centre point M of the circular opening in the holder 66 is arranged offset in relation to the centre point of the faces 69 of the adapter pieces 11-14 so that the first contact surface section 58 has a first distance z1, the second contact surface section 59 a second distance z2 and the third contact surface section 60 a third distance z3 from the centre point M of the holder 66, where z1<z2<z3. Distances z1 to z3 each differ for example by one millimeter.

The adapter pieces 11-14 consist of an electrically non-conductive plastic which has a degree of elasticity at least in its peripheral direction.

In the relaxed state, not applied to the allocated end section of the spring arms 48, 49, the holder 66 of the adapter pieces 11-14 has a diameter which is smaller by a slight amount than the also largely circular end sections of the spring arms 48, 49. When the end sections are pushed into place, the adapter pieces 11-14 are spread accordingly in the peripheral direction so that as a result of the return forces acting in the adapter pieces 11-14, they are held on the allocated end section by friction fit but rotatable with a slight force application. The adapter pieces 11-14 can easily be spread because of the slot 65 which thus not only prevents the collection of moisture in the adapter pieces 11-14 concerned but also facilitates the placing of the adapter pieces 11-14 on the respective end section of the spring arms 48, 49 and ensures their adequate elastic flexibility.

For pre-mounting of the system 1, first the support plate 3 is laid in the holder 19 of the foundation U. Then the elastic layer 4 is placed on the support plate 2 and the pressure distribution plate 5 on the elastic layer.

The guide plates 8, 9 are then positioned so that in each case one of them lies with its support section 46 on one of the shoulders 37, 38 which again are each supported on one of the support shoulders 20, 21 of the foundation U. The guide plates 8, 9 with their side feet 41, 42 surround the intermediate layer 4 and the pressure distribution plate 5 so that they stand on the support plate 3. The centre post 42*a* stands with its protrusion 42*b* in the slot of the intermediate layer 4 and the pressure distribution plate 5.

Then on the pressure distribution plate 5 is placed the height adjustment plate 6, the width of which corresponds to the clear distance between the guide plates 7, 8.

Then the spring elements 9, 10 with adapter pieces 11-14 attached thereto are placed onto the allocated guide plates 7, 8 so that their transition section sits on the support surface 47 of the respective support section 46. In this position the adapter pieces 11-14 are placed with their contact surface section 58-60 allocated to the sliding surface 56, 57 concerned on the respective sliding surface 56, 57 and held resting on the respective stop 54, 55. Then after the clamping elements 15, 16 are screwed through the passage opening 51 of the respective angle guide plate 7, 8 and the passage openings 30, 31 of the support plate 2 into the allocated plastic peg 22, 23, the system 1 is pre-clamped in its pre-assembly position.

After the rail S has been positioned, the spring elements 9, 10 are pushed in the direction of rail S until the adapter pieces 11-14 sit on their allocated side of the rail foot F and the transition sections of spring elements 9, 10 sit in the channel 50 of the guide plates 7, 8. The adapter pieces 11-14 then slide up the slide surfaces 56, 57 until they have passed the front free edge of steps 52, 53 and sit on the rail foot F.

If it is found that, as a result of excessive or too small a height difference between the top of the rail foot F and the top of the respective guide plate 7, 8, one of the spring elements 9, 10 exerts an insufficient or excessive retaining force on the rail foot F, this can be compensated by twisting the adapter piece 11-14 allocated to the spring element 9, 10 about its respective rotary axis D so that the adapter piece 11-14 concerned is supported on the rail foot F via a contact surface section 58, 59, 60 with a smaller distance (reduction of retention force) or a greater distance (increase in retention force) from the rotary axis D running through the centre point M of the holder 66.

The adapter pieces 11-14 thus allow very fine adjustment of the retaining forces applied by the spring elements 9, 10. At the same time they isolate the spring elements 9, 10 from the rail S.

If it is found that the height of the fixing point obtained by the system 1 for the rail S as a whole is too low, subsequently the additional support plate 2 and where applicable further support plates can be mounted below the support plate 3 in the manner already described above.

The invention claimed is:

1. A system for fixing a rail onto a foundation, comprising:

a spring element which can be clamped against the foundation by means of a clamping element, wherein the spring element has at least one spring arm;

an adapter piece which sits on an end section of the spring arm of the spring element, the adapter piece having a contact surface section formed at its periphery; and a guide plate, comprising a face allocated to a rail foot and a free top face;

the face allocated to the rail foot having a contact surface, and the free top face having a sliding surface adjoining the contact surface via which the adapter piece can be moved from a pre-assembly position in which it sits on the guide plate with its contact surface section into an assembly position in which it sits, with its contact surface section, on the rail foot of the rail to be fixed, in order to transfer an elastic retaining force exerted by the spring element onto the rail foot, wherein the sliding surface of the guide plate rises in the direction of the contact surface and a stop is provided on the sliding surface against which the adapter piece rests in the pre-assembly position.

2. The system according to claim 1, wherein the spring element is an ω-shaped clamp with two spring arms, such that one adapter piece is allocated to each of the spring arms, and such that on the guide plate a sliding surface which rises in the direction of the contact surface is provided for each of the adapter pieces.

3. The system according to claim 1, wherein the adapter piece electrically isolates the spring element from the rail foot.

4. The system according to claim 1, wherein the adapter piece is mounted on the end section of the spring arm to be rotatable on a rotary axis, such that the adapter piece has at its periphery at least two contact surface sections, one of which in each case, depending on the rotary position of the adapter piece at the time, rests against the rail foot, and such that one contact surface section of the adapter piece has a greater distance from the rotary axis of the adapter piece than the other contact surface section.

5. The system according to claim 1, wherein a support plate is provided which extends transverse to a rail to be fixed over the width of the guide plate and wherein the support plate is arranged to compensate for height differences between the guide plate and a foundation, the support plate having a rectangular base form and having a passage opening for a clamping element used for clamping the spring element, and wherein the support plate is divided into two parts along a joint line, the joint line starts at a long side of the support plate and is guided at a distance from a short side to a passage opening and intersects the passage opening and is further guided in the direction of the short side of the support plate.

6. A guide plate for a system formed in accordance with claim 1, the guide plate having a contact surface on its face allocated to the rail foot and on its free top face a sliding surface, for an adapter piece, which adjoins the contact surface, wherein the sliding surface of the guide plate rises in the direction of the contact surface and a stop is provided on the sliding surface by which a pre-assembly position for the adapter piece is defined.

7. The guide plate according to claim 6, wherein the sliding surface is even and of a uniform inclination.

8. The guide plate according to claim 6, wherein the stop for the adapter piece which is present on the guide plate is in the form of a step integrally formed on the guide plate.

9. The guide plate according to claim 6, wherein there is formed on its contact surface a protrusion which protrudes towards the rail and which is provided for engaging below the rail foot in the assembly position.

10. The guide plate according to claim 6, wherein a recess is formed in its underside.

11. The guide plate according to claim 6, comprising a support section on its side facing away from the contact surface, which has on its top face a contact surface to support a transition section of the respective spring element in a pre-assembly position and which at the same time limits a channel formed in the guide plate in which the transition section of the spring element sits in the fully assembled position.

12. The guide plate according to claim 11, wherein at least one recess is formed in the support section from the side facing away from the contact surface.

13. A system for fixing a rail onto a foundation, comprising:

a spring element which can be clamped against the foundation by means of a clamping element, wherein the spring element has at least one spring arm;

an adapter piece which sits on an end section of the spring arm of the spring element, the adapter piece having a contact surface section formed at its periphery; and a guide plate, comprising a face allocated to a rail foot and a free top face;

the face allocated to the rail foot having a contact surface, and the free top face having a sliding surface adjoining the contact surface via which the adapter piece can be moved from a pre-assembly position in which it sits on the guide plate with its contact surface section into an assembly position in which it sits, with its contact surface section, on the rail foot of the rail to be fixed, in order to transfer an elastic retaining force exerted by the spring element onto the rail foot, wherein the sliding surface of the guide plate comprises a portion which rises in the direction of the contact surface and a stop is provided on the sliding surface against which the adapter piece rests in the pre-assembly position; and wherein in the assembly position, the adapter piece does not contact the sliding surface portion which rises.

* * * * *

UNITED STATES PATENT AND TRADEMARK OFFICE

CERTIFICATE OF CORRECTION

PATENT NO. : 9,051,694 B2
APPLICATION NO. : 13/581880
DATED : June 9, 2015
INVENTOR(S) : Winfried Bosterling et al.

It is certified that error appears in the above-identified patent and that said Letters Patent is hereby corrected as shown below:

ON THE TITLE PAGE

Item (73) Assignee, delete "Wersohl" and insert -- Werdohl --

Signed and Sealed this
First Day of December, 2015

Michelle K. Lee

Michelle K. Lee
*Director of the United States Patent and Trademark Office*